US010836206B2

(12) United States Patent
Keane

(10) Patent No.: US 10,836,206 B2
(45) Date of Patent: Nov. 17, 2020

(54) PAINT BUCKET FOR HOLDING PAINT AND PAINT ACCESSORIES

(71) Applicant: Daniel Keane, Oakdale, NY (US)

(72) Inventor: Daniel Keane, Oakdale, NY (US)

( * ) Notice: Subject to any disclaimer, the term of this patent is extended or adjusted under 35 U.S.C. 154(b) by 0 days.

(21) Appl. No.: 16/366,494

(22) Filed: Mar. 27, 2019

(65) Prior Publication Data

US 2019/0322124 A1 Oct. 24, 2019

Related U.S. Application Data

(60) Provisional application No. 62/649,262, filed on Mar. 28, 2018.

(51) Int. Cl.
*B44D 3/12* (2006.01)
*A45F 5/02* (2006.01)

(52) U.S. Cl.
CPC ..... *B44D 3/12* (2013.01); *A45F 5/021* (2013.01); *B44D 3/126* (2013.01); *A45F 2200/0575* (2013.01)

(58) Field of Classification Search
CPC . B44D 3/126; B44D 3/125; A45F 2200/0575; A45F 5/021; Y10S 224/904
See application file for complete search history.

(56) References Cited

U.S. PATENT DOCUMENTS 3,493,152 A 2/1970 Ort
4,363,433 A 12/1982 Jaques
4,746,042 A 5/1988 King
5,072,868 A 12/1991 Dickie et al.
5,135,144 A * 8/1992 Blakely ..... A61B 50/31 224/240
5,163,591 A * 11/1992 Leiserson ..... A45F 5/02 224/148.6
5,489,051 A 2/1996 Robinson
6,719,178 B1 * 4/2004 Taylor ..... A45F 3/02 224/148.7
8,887,940 B2 * 11/2014 Kiceniuk, Jr. ..... B44D 3/121 206/361
9,463,662 B1 * 10/2016 Sotolongo ..... B44D 3/126
9,713,374 B1 * 7/2017 Page ..... B44D 3/126
10,420,414 B1 * 9/2019 Snyder ..... A45F 3/14
2002/0185509 A1 12/2002 Wichman et al.
2003/0089748 A1 * 5/2003 Whalen ..... B05C 17/0245 224/148.4
2004/0195280 A1 10/2004 Shackelford
2012/0037634 A1 * 2/2012 Kiceniuk, Jr. ..... B44D 3/121 220/495.02

(Continued)

*Primary Examiner* — Brian D Nash
(74) *Attorney, Agent, or Firm* — Carter, DeLuca & Farrell LLP

(57) ABSTRACT

A paint bucket includes a housing having a trough defined therein for holding paint and/or paint accessories. The housing includes a pair of apertures defined in a back panel thereof that extend therethrough. Each aperture is disposed proximate an opposing side of the housing. A band is adapted to engage between belt loops on a pair of pants. A pair of selectively engageable loops is each configured to engage both a corresponding aperture defined in the back panel of the housing and the band to secure the paint bucket thereto such that the paint bucket remains upright as a painter navigates a ladder or a sloped terrain.

4 Claims, 4 Drawing Sheets

(56) References Cited

U.S. PATENT DOCUMENTS

| | | | | |
|---|---|---|---|---|
| 2016/0101646 | A1* | 4/2016 | Kiceniuk | B44D 3/126<br>224/191 |
| 2016/0324301 | A1* | 11/2016 | Babb | A45F 5/021 |
| 2017/0055684 | A1* | 3/2017 | Jackson | B44D 3/123 |

* cited by examiner

PAINT BUCKET FOR HOLDING PAINT AND PAINT ACCESSORIES

CROSS-REFERENCE TO RELATED APPLICATION

This application claims the benefit of, and priority to, U.S. Provisional Patent Application. No. 62/649,262 entitled BASKET OR BUCKET ATTACHED TO BELT LOOPS FOR HOLDING PAINT, filed on Mar. 28, 2018, the entire contents of which is incorporated herein by reference.

BACKGROUND

Technical Field

The present disclosure relates to devices for holding paint and paint accessories.

Description of Related Art

Painting the exterior or interior walls of a house frequently requires the use of implements such as a roller to cover large surfaces and a brush for trim or corners. Traditionally, a container or bucket is utilized for the supply of the paint to avoid repeated trips up and down a ladder or scaffolding. As can be appreciated, providing an ample amount of paint and securing the paint accessories (brush and rollers) when not in use may present certain issues especially when working atop a ladder or stool.

For example, when using a roller, the painter is presented with the issue of where to securely store the brush which is not being used and vice versa. With particular regard to the brush, while it is desirable to keep the lower portion of the bristles in paint to prevent drying, it is not desirable to submerge the entire brush within the container of paint. Rollers, while typically provided with a hook that engages a bucket, it may not be desirable to hang the roller in all instances. Moreover, it is often desirable to remove a portion of the paint from the brush and the roller immediately prior to use or after use which adds to the difficulty of using known prior art devices.

Further complicating the use of typical prior art devices is the ability for a painter to safely transport the paint in the bucket without spillage due to normal movement up a ladder and while on a ladder. Many prior art devices are known that employ flanges, cuffs or the like that are configured to attach the bucket to the painter's belt or waist strap for transport up and down a ladder. However, devices that attach to a belt or painter's waist strap tend move in unison with the belt or waist strap which may cause the bucket to tip when navigating up and down a ladder or when walking up steep grades.

SUMMARY

In accordance with aspects of the present disclosure a paint bucket includes a housing having a trough defined therein for holding paint and/or paint accessories. The housing includes a pair of apertures defined in a back panel thereof that extend therethrough. Each aperture is disposed proximate an opposing side of the housing. A band is adapted to engage between belt loops on a pair of pants. A pair of selectively engageable loops is each configured to engage both a corresponding aperture defined in the back panel of the housing and the band to secure the paint bucket thereto such that the paint bucket remains upright as a painter navigates a ladder or a sloped terrain.

In aspects according to the present disclosure, a grid is disposed at least partially within the trough, the grid configured to remove excess paint from a roller when the roller is moved therealong. In other aspects according to the present disclosure, the grid includes a waffle-like or honeycombed pattern across a face thereof. The grid may be selectively removable from the trough.

In aspects according to the present disclosure, each selectively engageable loop is configured to engage and lock to itself to secure the paint bucket to the band. In other aspects according to the present disclosure, each selectively engageable loop is disposable or adjustable.

In accordance with other aspects of the present disclosure, a paint bucket, includes a housing having a trough defined therein for holding paint and/or paint accessories. The housing includes a pair of apertures defined in a back panel thereof that extending therethrough. Each aperture is disposed proximate an opposing side of the housing.

A flange is operably associated with the back panel of the housing and includes a pair of windows defined therein. Each window is disposed in substantial vertical registration with a corresponding aperture forming a corresponding window/aperture combination. A pair of s-shaped cuffs having opposing ends is included, each end of each cuff is configured to engage a corresponding window and a corresponding aperture of a respective window/aperture combination. A band is adapted to weave around each corresponding cuff and around the flange to ultimately secure to a pair of belt loops disposed on a pair of pants such that the paint bucket remains upright as a painter navigates a ladder or across sloped terrain.

In aspects according to the present disclosure, a grid is disposed at least partially within the trough, the grid is configured to remove excess paint from a roller when the roller is moved therealong. In other aspects according to the present disclosure, the grid includes a waffle-like or honeycombed pattern across a face thereof. In still other aspects according to the present disclosure, the grid is selectively removable from the trough.

BRIEF DESCRIPTION OF THE DRAWINGS

Various aspects and features of the present disclosure are described hereinbelow with references to the drawings, wherein.

DETAILED DESCRIPTION

Portable devices for holding paint and paint accessories are provided in accordance with the present disclosure and are described in detail below.

Figure 1A:
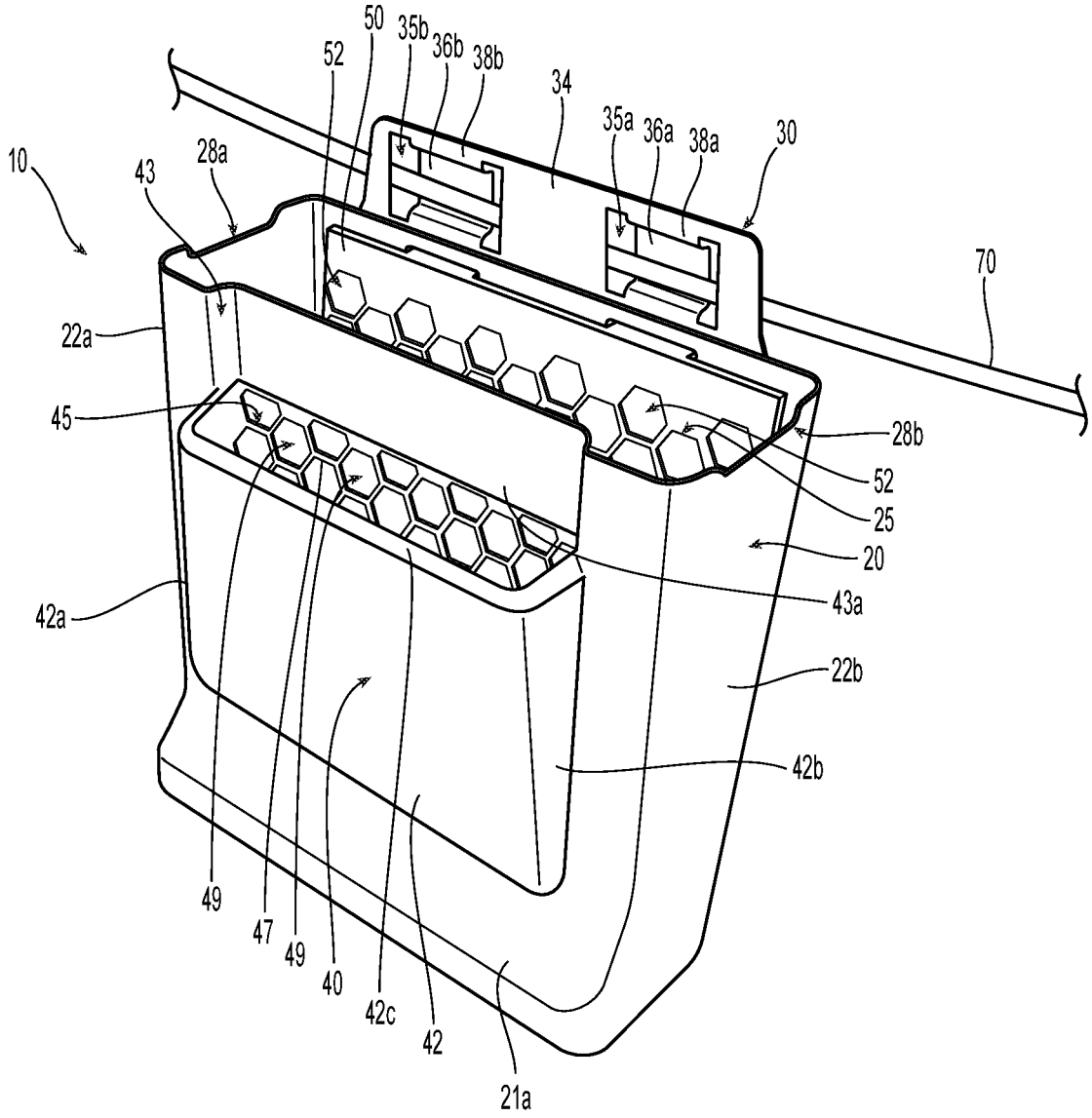
FIG. 1A is a front, perspective view of a portable paint bucket for holding paint and paint accessories in accordance with the present disclosure.

With reference to FIGS. 1 and 1A, a portable paint bucket for holding paint and paint accessories is provided and is generally referenced as paint bucket 10. Paint bucket 10 includes a housing 20 including front and back panels 21*a*, and 21*b*, respectively, and right and left sides 22*a* and 22*b* which together define a trough 25 for receiving paint and paint accessories (not shown) therein as explained in more detail below. More particularly, trough 25 is dimensioned to receive a standard-sized roller 200 with roller handle thereon (See FIG. 2B) but may be dimensioned to receive other sized rollers. A paint grid 50 is disposed within the trough 25 and extends therealong from a top portion of the trough 25 to a bottom portion of the trough 25. A smaller or larger grid 50 may be employed depending on particular purpose. Paint grid 50 includes a series of honey-combed shaped apertures 52 defined therein arranged in an array-like manner and extending a substantial length thereof. The honey-combed shaped apertures 52 are configured to eliminate excess paint from sticking to the roller 200 as the roller 200 slides therealong. Other shapes of the apertures 52 are envisioned that can serve the same or similar purpose.

The trough 25 may be tapered depending on a particular purpose or to achieve a particular result, e.g., lower profile, less weight, impede toe roller from completely soaking into the paint, etc. The trough 25 may also include one or more notches 28*a*, 28*b* defined in the top portion thereof that are configured to, inter alia, facilitate introduction of the roller 200 into the trough 25 or support a clip on the roller 200 or the brush for hanging purposes.

One or more engagement hangers 30 are attached to (or integrally associated with) the back panel 21*b* and are configured to selectively engage the paint bucket 10 to a user for transport. More particularly, engagement hanger 30 of FIGS. 1A and 1B includes a generally rectilinear flange 34 including two windows 35*a*, 35*b* defined therein configured to receive a band 70 therethrough. Each window 35*a*, 35*b* includes a corresponding cuff 36*a*, 36*b* associated therewith that is configured to engage the band 70 when the band 70 is weaved through flange 34. Unlike prior are devices which attached to a belt or around the waist and move with the painter's "P" hip when going up and down steep inclines or ladders causing the paint bucket to tip, attaching the present paint bucket 10 in this manner provides additional stability when navigating steep hills and up and down ladders since the paint bucket 10, when engaged to a painter's "P" hip as described herein, will remain upright through all manner of navigation, e.g., hills, ladders, lying flat, etc. (See FIG. 2B).

Front panel 21*a* of paint bucket 10 includes a cantilevered portion 42 that extends therefrom configured to receive a paint brush therein (not shown). Cantilevered portion 42 includes a brush trough opening 45 defined by the top of side panels 42*a*, 42*b* and the top of front panel 42. Cantilevered portion 42 is configured to extend from a recess 43 defined in the front panel 21*a*. Positioning the cantilevered portion 42 within the recess 43 reduces the overall profile of the paint bucket 10. Brush trough 45 is disposed in communication with trough 25 to facilitate access to the same paint disposed therein. A lower edge 43*a* of the recess 43 may be designed to include a rubber-like or silicone feature that facilitates removal of excess paint on the paint brush. An inner edge 42*c* of the cantilevered portion 42 may also include a rubber-like or silicone feature for similar purposes.

Figure 1B:
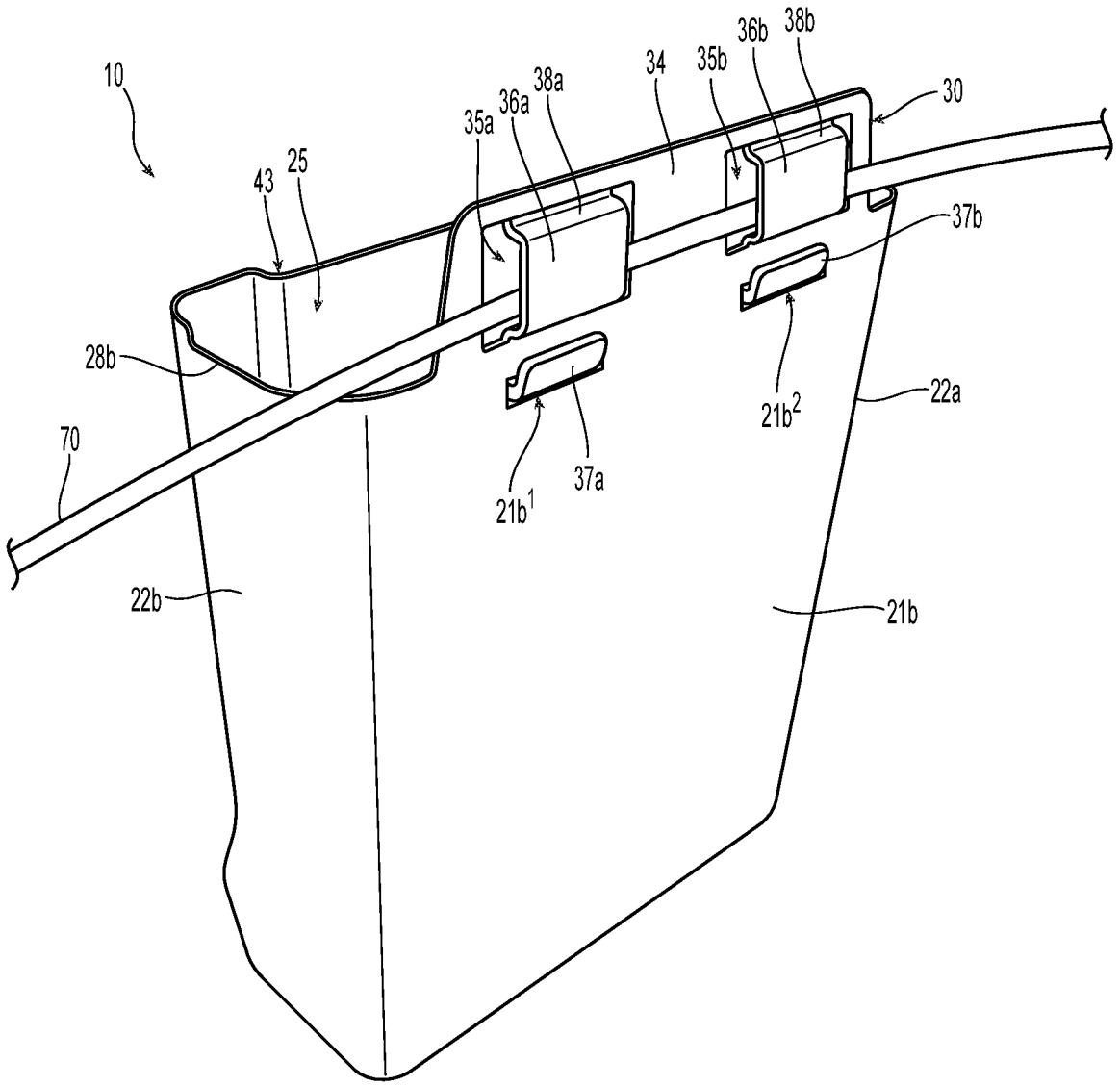
FIG. 1B is a rear, perspective view of the portable paint bucket of FIG. 1A.

FIG. 1B shows a rear view of the paint bucket 10 and highlights how the band 70 weaves through the flange 34 to facilitate engagement to a painter's "P" hip. As can be appreciated, a lower end 37*a*, 37*b* of each respective cuff 36*a*, 36*b* is snapped into place within apertures 21*b*1 and 21*b*2 defined within back panel 21*b*. Upper ends 38*a*, 38*b* of cuffs 36*a*, 36*b* engage inner peripheral edges of respective windows 35*a*, 35*b* to secure the cuffs 36*a*, 36*b* to the paint bucket 10 for engagement to the band 70 and ultimately the painter's "P" hip. Cuff's 36*a*, 36*b* are shaped in a generally S-like manner to facilitate engagement of each opposing end 38*a*, 37*a* and 38*b*, 37*b* within each respective aperture and window combination, 21*b*1, 35*a*, and 21*b*2, 35*b*. Other ways of securing the paint bucket 10 to a painter's "P" hip are described below with respect to FIGS. 2A and 2B. Band 70 is, in turn, looped around a pair of belt loops (not shown) on a painter's pants and then secured to the paint bucket 10 or the band may be secured to itself, e.g., snap lock, zip-tie, hook and loop interengaging fasteners (Velcro®), etc.

Figure 2A:
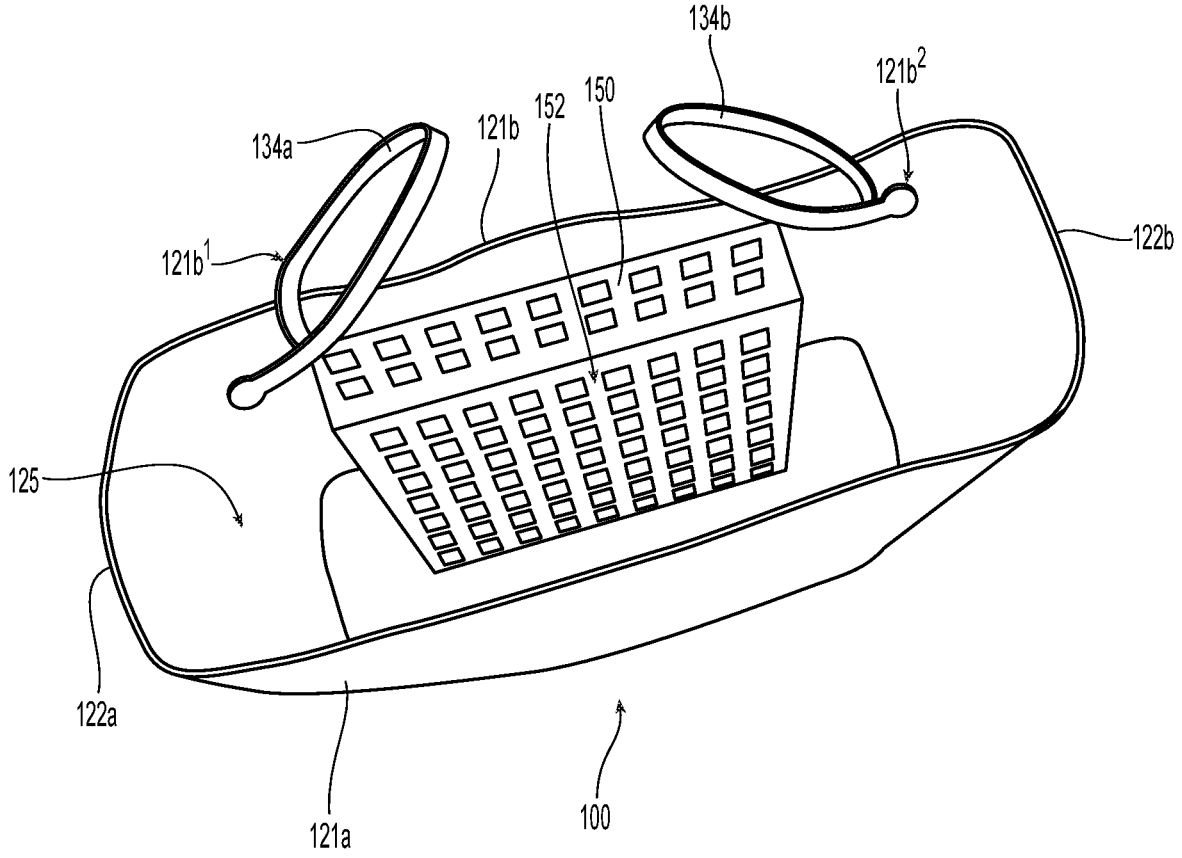
FIG. 2A is a top, perspective view of another embodiment of a portable paint bucket for holding paint and paint accessories in accordance with the present disclosure.
Figure 2B:
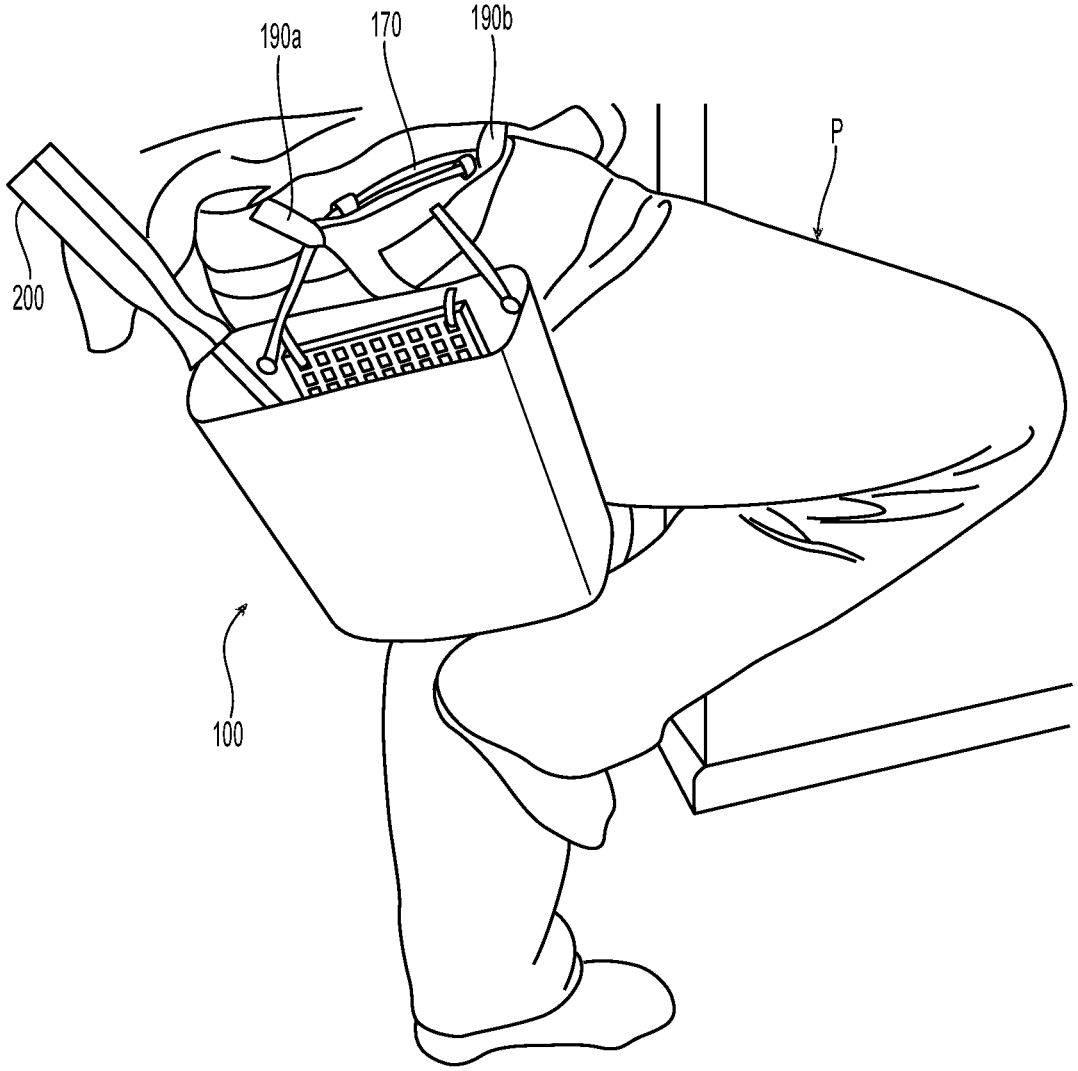
FIG. 2B is a side, perspective view of the portable paint bucket of FIG. 2A shown in use.

FIGS. 2A and 2B show another embodiment of a paint bucket 100 of the present disclosure. Paint bucket 100 includes similar features as described above with respect to paint bucket 10 and only those features necessary to describe the differences in structure and/or operation are described below. Paint bucket 100 includes front and rear panels 121*a*, 121*b* and opposing sides 122*a*, 122*b* that define trough 125 for containing paint and a roller 200 (FIG. 2B) therein. Similar to paint bucket 10 described above, a grid 150 is disposed within trough 125 and is utilized to remove excess paint from the roller 200 when the roller 200 is pulled from trough 125 for use. The grid 150 may include apertures 152 arranged in a waffle-like pattern or honey combed pattern to facilitate removal of paint when the roller 200 is moved thereacross. The grid 150 (or 50) may be selectively removable from the trough 125 (or 25).

Much like paint bucket 10, paint bucket 100 is configured to rest on a painter's "P" hip to facilitate access to the paint and paint accessories (roller, brush, etc.) during use. Back panel 121*b* includes a series of apertures 121*b*1, 121*b*2 defined therein that are each configured to receive loop 134*a*, 134*b* therethrough. Loops 134*a*, 134*b* are each designed to be selectively adjustable, selectively removable and/or selectively disposable depending upon a particular purpose. As shown, each loop, e.g., loop 134*a*, is configured to be fed through aperture 121*b*1 in the back panel 121*b* of paint bucket 100 and fed through a corresponding band 170 affixed between belt loops 190*a*, 190*b* of a painter's "P" pants. Once each loop 134*a*, 134*b* is fed through the band 170, each loop is secured either to itself or to the paint bucket 100 in some fashion, e.g., snap lock, zip-tie, hook and loop interengaging fasteners (Velcro®), etc. The paint bucket 100 is now hung for use on a painter's "P" hip.

Once again and unlike prior are devices which attach to a belt or around the waist and move with the painter's "P" hip which may cause the paint bucket to tip, attaching the present paint bucket 10 in this manner provides additional stability when navigating steep hills and up and down ladders since the paint bucket 100, when engaged to a painter's hip as described in FIGS. 2A, 2B, will remain upright through all manner of navigation, e.g., hills, ladders, lying flat, etc.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A paint bucket, comprising:

a housing including a trough defined therein for holding at least one of paint and paint accessories, the housing including a pair of apertures defined in a back panel thereof and extending therethrough, each aperture disposed proximate an opposing side of the housing;

a flange operably associated with the back panel of the housing and including a pair of windows defined therein, each window disposed in substantial vertical registration with a corresponding aperture forming a corresponding window/aperture combination;

a pair of s-shaped cuffs having opposing ends, each end of each cuff configured to engage a corresponding window and a corresponding aperture of a respective window/aperture combination; and a band adapted to weave around each corresponding cuff and around the flange to ultimately secure to a pair of belt loops disposed on a pair of pants such that the paint bucket remains upright as a painter navigates a ladder or across sloped terrain.

2. The paint bucket according to claim 1 further comprising a grid disposed at least partially within the trough, the grid configured to remove excess paint from a roller when the roller is moved therealong.

3. The paint bucket according to claim 2 wherein the grid includes a waffle-like or honey-combed pattern across a face thereof.

4. The paint bucket according to claim 2 wherein the grid is selectively removable from the trough.

* * * * *